US007678739B2

(12) United States Patent
Hashiba et al.

(10) Patent No.: US 7,678,739 B2
(45) Date of Patent: Mar. 16, 2010

(54) THERMAL TRANSFER SHEET

(75) Inventors: Makoto Hashiba, Tokyo (JP); Daisuke Fukui, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 367 days.

(21) Appl. No.: 11/628,975

(22) PCT Filed: Jun. 14, 2005

(86) PCT No.: PCT/JP2005/010871

§ 371 (c)(1),
(2), (4) Date: Dec. 8, 2006

(87) PCT Pub. No.: WO2005/123413

PCT Pub. Date: Dec. 29, 2005

(65) Prior Publication Data

US 2009/0041957 A1 Feb. 12, 2009

(30) Foreign Application Priority Data

Jun. 17, 2004 (JP) ..... 2004-179830
Sep. 9, 2004 (JP) ..... 2004-262523
Mar. 31, 2005 (JP) ..... 2005-103720

(51) Int. Cl.
*B41M 5/41* (2006.01)

(52) U.S. Cl. ..... 503/227; 428/32.64

(58) Field of Classification Search ..... None
See application file for complete search history.

(56) References Cited

U.S. PATENT DOCUMENTS

2001/0034302 A1 10/2001 Suzuki et al.

FOREIGN PATENT DOCUMENTS

| | | | |
|---|---|---|---|
| JP | 61-184717 | A | 8/1986 |
| JP | 62-220385 | A | 9/1987 |
| JP | 5-229271 | A | 9/1993 |
| JP | 5-229272 | A | 9/1993 |
| JP | 8-113647 | A | 5/1996 |
| JP | 8-244369 | A | 9/1996 |
| JP | 10-297124 | A | 11/1998 |
| JP | 2001-205947 | A | 7/2001 |
| JP | 2001-334760 | A | 12/2001 |

*Primary Examiner*—Bruce H Hess
(74) *Attorney, Agent, or Firm*—Birch Stewart Kolasch & Birch, LLP

(57) ABSTRACT

To provide a thermal transfer sheet having a back layer excellent in heat resistance and slipping properties and causing no wrinkling at printing and no image-defect by tailing, the sheet being able to be prepared without a heat treating, such as aging.

A thermal transfer sheet, comprising a substrate film, a transfer ink layer formed on one face thereof, and a back layer formed on the other face thereof, wherein the back layer comprises:

a mixed binder containing a polyamide-imide resin (A) having a Tg of 200° C. or higher as determined by differential thermal analysis and a polyamide-imide silicone resin (B) having a Tg of 200° C. or higher;

a mixture of a polyvalent metal salt of alkylphosphoric ester (C) and a metal salt of alkylcarboxylic acid (D), a silicone oil (E); and an inorganic filler (F).

7 Claims, 1 Drawing Sheet

THERMAL TRANSFER SHEET

The present application is a National Stage entry of PCT/JP2005/010871 filed on Jun. 14, 2005. Priority is also claimed to Japanese patent application 2004-179830 filed Jun. 17, 2004 and Japanese patent application 2004-262523 filed Sep. 9, 2004 under 35 U.S.C. §119.

TECHNICAL FIELD

The present invention relates to a thermal transfer sheet used in thermal transfer printers by using heating means such as thermal head.

BACKGROUND ART

When used as a substrate of thermal transfer sheet, a plastic film susceptible to heat causes problems such as deterioration in releasing and slipping efficiency and breakage of the substrate film because of adhesion (sticking) of the film to the thermal head during printing and resulting deposition of foreign matter. A method of forming a heat-resistant layer, for example, of a higher heat-resistant thermosetting resin was proposed, but the method does not improve the slipping efficiency of thermal head, although it improves the heat resistance, and demands use of a two-component coating solution because the coating solution should contain a hardening agent such as a crosslinking agent. In addition, it demands a long-term heat treatment (aging) over dozens of hours at relatively low temperature after coating for production of a sufficient hardened film, because the substrate is a thin plastic film prohibiting high-temperature processing. Thus, the method demands complicated production processes and also causes problems such as generation of cockles during heat treatment without strict temperature control and occurrence of blocking because of the contact of an opposing face with the coated face.

Addition of a lubricant such as silicone oil, low-melting point WAX, or surfactant was proposed for improvement in slipping efficiency, but use of an unsuitable lubricant causes a problem of deterioration in image intensity and image blurring because of the transfer onto the opposite face when the thermal transfer sheet is wound and the deposition of foreign matter on the thermal head during printing. Alternatively, a method of adding a filler for removal of the deposit is also known, but use of a unsuitable filler causes problems such as generation of cockles during printing by increase of friction coefficient with the thermal head and abrasion of the thermal head.

Patent Documents 1 and 2 disclose a back layer of a silicone-modified polyurethane resin; Patent Document 3, a heat resistance protective layer of a polysiloxane-polyamine block copolymer; Patent Document 4, a heat-resistant protective layer containing a silicone-modified polyimide resin, to solve the problems above, but these layers, which are lower in heat resistance as a resin, often caused problems such as sticking during high-energy printing and also problems in working environment because of use of a special solvent, demanding an additional exhaust device. Alternatively, Patent Documents 5 and 6 disclose polyamide-imide resin compositions, and Patent Document 7, a heat-resistant protective layer containing a polyamide-imide resin and a lubricant, but these materials are also insufficient in heat resistance and caused a problem of the deterioration in the quality of printed image by deposition of foreign matter on the head during high-energy printing.

As shown in FIG. 1, a thermal head used in thermal transfer recording is constituted by a heat-resistant layer 5, a heat-generating resistor 2, an electrode 3, and an abrasion-resistant layer 4 formed on a heat-releasing substrate 1, and thin-film thermal heads are commonly used. The heat-releasing substrate 1 is, for example, made of a ceramic, the heat-resistant layer 5, for example of glass, is formed as it is raised on the heat-releasing substrate 1. The maximum thickness is 20 to 150 μm, and the heat conductivity thereof is approximately 0.1 to 2 Watt/m·deg. The heat-generating resistor 2 is made of $Ta_2N$, W, Cr, Ni—Cr, $SnO_2$, or the like, and formed linearly by using a thin-film-forming method such as vacuum deposition, CVD, or sputtering, and the thickness thereof is approximately 0.05 to 3 μm. The electrode 3 is, for example, made of Al, and formed on the heat-generating resistor 2 for supply of electricity, in the region excluding the top area of the raised heat-resistant layer 5, and the thickness thereof is approximately 0.1 to 34 μm. The abrasion-resistant layer 4 is, for example, made of $Ta_2O_3$, SiN, or SiC.

Under the condition of thermal head, various image patterns in full color are formed and used as thermal transfer images. However among many printing conditions, in the condition where dense solid images and half-tone images are printed together i.e., when the heating energy applied to the thermal head fluctuates between high and low levels rapidly, there is caused a problem of staining due to tailing in the half-tone image, presumably by the influence of the foreign matter temporarily deposited in the area in contact between the thermal head and the back face of the thermal transfer sheet.

Patent Document 1: Japanese Patent Application Laid-Open No. Sho 61-184717

Patent Document 2: Japanese Patent Application Laid-Open No. Sho 62-220385

Patent Document 3: Japanese Patent Application Laid-Open No. Hei 5-229271

Patent Document 4: Japanese Patent Application Laid-Open No. Hei 5-229272

Patent Document 5: Japanese Patent Application Laid-Open No. Hei 8-113647

Patent Document 6: Japanese Patent Application Laid-Open No. Hei 8-244369

Patent Document 7: Japanese Patent Application Laid-Open No. Hei 10-297124

DISCLOSURE OF INVENTION

Technical Problems to be Solved

An object of the present invention, which was made in view of the circumstances above, is to provide a thermal transfer sheet having a back layer that can be produced without heat treatments such as aging by using a single-liquid coating solution containing a common solvent instead of a special solvent hazardous during production and in working environment, is superior in heat resistance and slipping efficiency, and prevents the defects of printed image, for example by wrinkling and staining due to tailing during printing.

Means for Solving the Problems

Thus, the present invention relates to a thermal transfer sheet, comprising a substrate film, a transfer ink layer formed on one face thereof, and a back layer formed on the other face thereof, wherein the back layer includes a mixed binder containing a polyamide-imide resin (A) having a Tg of 200° C. or higher as determined by differential thermal analysis and a polyamide-imide silicone resin (B) having a Tg of 200° C. or higher, and additionally, a mixture of a polyvalent metal salt of alkylphosphoric ester (C) and a metal salt of alkylcarboxylic acid (D), a silicone oil (E) and an inorganic filler (F).

The thermal transfer sheet according to the present invention can be produced without heat treatment such as aging, is superior in heat resistance and slipping efficiency, and prevents the defects of printed image caused by wrinkling and staining due to tailing during printing.

DESCRIPTION OF REFERENCE NUMERALS

Figure 1:
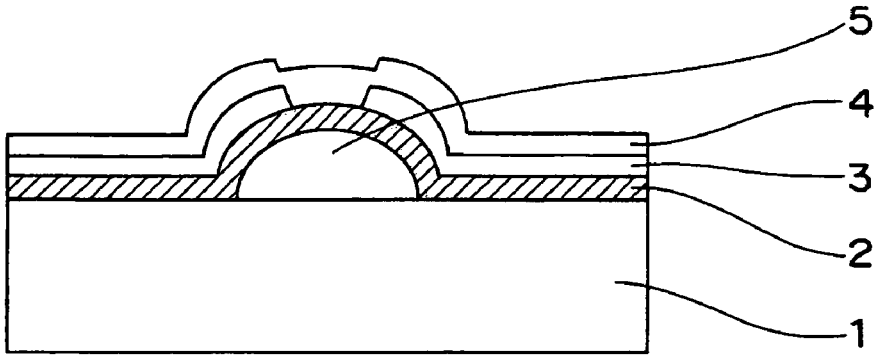
FIG. 1 is a schematic view illustrating a thermal head for thermal transfer recording.

1: Heat-releasing substrate
2: Heat-generating resistor
3: Electrode
4: Abrasion-resistant layer
5: Heat-resistant layer

BEST MODE FOR CARRYING OUT THE INVENTION

The thermal transfer sheet according to the present invention essentially includes a substrate film, an ink-transfer layer on one face thereof, and a back layer on the other face thereof.

(Substrate Film)

The substrate film constituting the thermal transfer sheet according to the present invention may be any one of known films, if it has heat resistance and strength to some extent, and examples thereof include films having a thickness of approximately 0.5 to 50 μm, preferably 3 to 10 μm, such as polyethylene terephthalate film, 1,4-polycyclohexylene dimethylene terephthalate film, polyethylene naphthalate film, polyphenylene sulfide film, polystyrene film, polypropylene film, polysulfone film, aramide film, polycarbonate film, polyvinyl alcohol film, films of cellulose derivatives such as cellophane and cellulose acetate, polyethylene film, polyvinyl chloride film, nylon film, polyimide film, and ionomer film; papers such as capacitor paper, paraffin paper, and paper; nonwoven fabric; and composites of a nonwoven fabric or paper with another nonwoven fabric and a resin.

(Back Layer)

The binder for the back layer is a mixture of a polyamide-imide resin (A) and a polyamide-imide silicone resin (B). The resins are used at a ratio A:B of 1~5:5~1, preferably 1~2:2~1 (mass ratio). Presence of the polyamide-imide silicone resin at a ratio of more than 1:5 leads to deterioration in the heat resistance of the back layer formed and consequently easier deposition of foreign matter on the head, while presence of the polyamide-imide silicone resin at a ratio of less than 5:1 leads to deterioration in smoothness of the back layer formed and consequently more frequent sticking of thermal head.

Examples of the polyamide-imide and polyamide-imide silicone resins include those described in Japanese Patent Application Laid-Open No. Hei 8-244369, and, among them, those having a Tg of 200° C. or higher, as determined by differential thermal analysis, are particularly preferable. A Tg of lower than 200° C. leads to deterioration of the heat resistance of the polyamide-imide resin or polyamide-imide silicone resin. The upper limit of Tg is not particularly limited from the viewpoint of heat resistance, but preferably, approximately 300° C. from the viewpoint of solubility in common solvents.

The polyamide-imide silicone resin for use in the present invention is prepared by copolymerization of a multifunctional silicone compound having a molecular weight of 1,000 to 6,000 with a polyamide-imide resin or by modification of a polyamide-imide resin with silicone. The multifunctional silicone compound preferably used is a silicone compound having a hydroxyl, carboxyl, epoxy, amino, or acid anhydride group. The content of the silicone is 0.01 to 0.3 part with respect to 1 part of the polyamide-imide resin by mass. When the copolymerization or modification rate of the silicone is too low, it is not possible to obtain a back layer having sufficient smoothness in the mixing range above, often leading to sticking of thermal head. When the copolymerization or modification rate of the silicone is too high, the heat resistance and film strength of the back layer formed decline.

The polyamide-imide and polyamide-imide silicone resins for use in the present invention are preferably soluble in alcoholic solvents, from the general viewpoint of safety in working environment during production.

The back layer according to the invention contains a polyvalent metal salt of alkyl phosphoric ester and a metal salt of alkylcarboxylic acid. The polyvalent metal salt of alkyl phosphoric ester is prepared by substituting the alkali-metal salt of an alkyl phosphoric ester with a polyvalent metal. Such salts are known as additives for plastics, and salts in various grades are commercially available.

Favorable polyvalent metal salts of alkylphosphoric ester include the compounds represented by the following Formula 1:

[Formula 1]

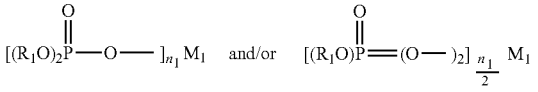

In the Formulae above, $R_1$ represents an alkyl group having 12 or more carbon atoms, preferably a $C_{12}$ to $C_{18}$ alkyl group from the viewpoint of slipping efficiency during printing, and specifically represents a cetyl, lauryl, or stearyl group, particularly preferably a stearyl group. $M_1$ represents an alkali-earth metal, preferably barium, calcium, magnesium, zinc or aluminum. $n_1$ represents the valency of $M_1$.

Favorable metal salts of alkylcarboxylic acid are represented by the following Formula 2:

[Formula 2]

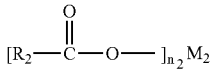

In the Formula above, $R_2$ represents an alkyl group having 11 or more carbon atoms, preferably a $C_{11}$ to $C_{18}$ alkyl group from the viewpoint of slipping efficiency during printing, and specifically represents a dodecyl, hexadecyl, heptadecyl, or octadecyl group, more preferably a dodecyl, heptadecyl, or octadecyl group, and particularly preferably an octadecyl group (stearyl group). $M_2$ represents an alkali-earth metal, preferably barium, calcium, magnesium, zinc, aluminum or lithium. $n_2$ represents the valency of $M_2$.

An alkylcarboxylic salt having a smaller number of $R_2$ carbons is undesirable, because such a compound is less commercially available and expensive and causes problems such as the bleeding of the lubricant out of the back layer and the staining onto other areas due to decline of the molecular weight of the entire compound. The metal $M_2$ may be selected arbitrarily according to the temperature condition used during thermal transfer. For reference, the melting point of barium-based salts is 190° C. or higher; that of calcium-based salts, approximately 140 to 180° C.; that of magnesium-based salts, approximately 110 to 140° C.; that of zinc-based salts, approximately 110 to 140° C.; that of aluminum-based salts, approximately 110 to 170° C.; and that of lithium-based salts, 200° C. or higher. Magnesium-, zinc-, and aluminum-based salts are preferable, and zinc-based salts are particularly preferable in the present invention.

The polyvalent metal salt of alkylphosphoric ester (C) and the metal salt of alkylcarboxylic acid (D) are preferably used at a mass ratio C:D of 1:9 to 9:1, preferably 2:8 to 8:2. Addition of the metal salt of alkylcarboxylic acid in an excessively larger amount leads to easier deposition of foreign matter on thermal head, while addition in an excessively smaller amount to decrease in the advantageous effects by addition.

The mixture of the polyvalent metal salt of alkylphosphoric ester (C) and the metal salt of alkylcarboxylic acid (D) is preferably used in an amount of 1 to 100 parts by mass, preferably 5 to 30 parts by mass, with respect to 100 parts by mass of the binder. An excessively smaller amount of the mixture used leads to insufficient release efficiency of the thermal head during heat application and thus easier deposition of foreign matter on the thermal head. On the other hand, an excessively larger amount unfavorably leads to deterioration in physical strength of the back-layer.

The silicone oil contained in the back layer is used as a lubricant, and a modified or unmodified silicone oil or the mixture thereof having a viscosity of 10 to 1,100 $mm^2$/sec, preferably 30 to 1,000 $mm^2$/sec, is used. A high-viscosity silicone oil, which is less compatible with the binder resin, leads to insufficient release efficiency, prohibiting prevention of the staining on printed image. A low-viscosity silicone oil, when used, causes a problem of transfer of the silicon oil onto the opposite face when the thermal transfer sheet is wound.

Favorable examples of the modified silicone oils for use include epoxy-, carbinol-, phenol-, methacrylic- or polyether-modified silicone oils, and those of the unmodified silicone oils include dimethylsilicone oil, methylphenylsilicone oil, and the mixture thereof. Blending of two or more silicone oils is effective in improving release efficiency and printed-image-staining preventive efficiency. In particular, blending of silicone oils different in viscosity is more effective in improving release characteristics. For example, a combination of a silicone oil having a viscosity of 100 $mm^2$/sec or less and another silicone oil having a viscosity of 100 $mm^2$/sec or more is favorably used in the viscosity range above. When two or more silicone oils are mixed, a combination of a modified silicone oil and an unmodified silicone oil is preferable, because it is effective in improving heat resistance, wrinkling resistance, release efficiency, and others.

The silicone oil is contained in an amount of 1 to 30 parts by mass, preferably 1 to 10 parts by mass, with respect to 100 parts by mass of the binder. An excessively larger content thereof causes problems such as transfer of the silicone oil onto the opposite face when the thermal transfer sheet is wound and deposition of foreign matter on the thermal head during printing, which lead to deterioration in image intensity and formation of low-density image. An excessively smaller content prohibits sufficient release efficiency and printed-image-staining preventive efficiency.

The inorganic filler contained in the back layer is preferably inorganic fine particles having a Mohs' hardness of 3 or less. A filler having a Mohs' hardness of more than 3 leads to easier progress of abrasion of thermal head and increase in the friction coefficient with the thermal head, and in particular to increase of the difference in friction coefficient between the non-printed and printed areas, which in turn lead to easier wrinkling of printed image. It also unfavorably leads to significant increase of the defects on the image formed on the image printed face, when the filler is separated from the back layer.

The inorganic filler for use in the present invention is known compounds, and examples thereof include talc, kaolin, mica, plumbago, niter, gypsum, brucite, graphite, calcium carbonate, molybdenum disulfide, and the like, and talc, mica and calcium carbonate are particular preferable from the point of balance between heat resistance and smoothness.

Even when the inorganic filler is a natural inorganic filler containing impurities having a Mohs' hardness of more than 3, it may be used without problem in the present invention, if it contains these impurity particles in an amount of less than 5 percent by mass. The Mohs' hardness is determined by using a Mohs' hardness meter. The Mohs' hardness meter, which was invented by F. Mohs, uses ten kinds of soft to hard minerals, stored in a box, each having a hardness of 1 to 10 degrees. The standard minerals used are the followings (number indicates hardness). 1: talc, 2: gypsum, 3: calcite, 4: fluorite, 5: apatite, 6: orthoclase, 7: quartz, 8: topaz, 9: corundum, and 10: diamond The hardness of a mineral can be determined by comparing the resistances to scratching (presence of scratches) when the surface thereof is rubbed with each of the standard minerals. For example, when calcite is scratched, the sample mineral has a hardness of more than 3. When a mineral is scratched with fluorite but fluorite is not scratched, the mineral has a hardness of smaller than 4. The hardness of the sample is expressed as 3 to 4 or 3.5. When the sample and the standard mineral are both scratched, the sample has a hardness same as that of the standard mineral. The hardness determined by using a Mohs' hardness meter is a ranking and not an absolute value.

The amount of the filler added is in the range of 2 to 20 parts by mass, particular 5 to 15 parts by mass with respect to 100 parts by mass of the binder, for obtaining favorable smoothness and heat resistance. An amount below the range above prohibits improvement of heat resistance and leads to fusion on the thermal head, while an amount exceeding the range leads to deterioration in flexibility and film strength of the back layer.

The average particle size of the filler is also important, and is preferably in the range of 0.05 to 5 μm, although it may vary according to the thickness of the back layer formed. A filler having an average particle size of more than 5 μm is unfavorable, because it leads to easier progress of abrasion of the thermal head and significant increase of scratches formed on the image-printed face when the filler is separated from the back layer. A filler having an average particle size of less than 0.05 μm is also unfavorable, because it leads to deterioration in cleaning efficiency when the foreign matter is deposited on the thermal head.

The back layer is formed by preparing a coating solution by dissolving the materials described above in a solvent for binder such as a mixed solvent of toluene and ethanol at a ratio of 1:1 and coating and drying the coating solution by a common coating method such as gravure coater, roll coater, or wire bar coating. As for the amount of the back layer coated, it is possible to form a back layer having sufficiently favorable properties, by forming a layer having a thickness of 0.7 $g/m^2$ or less, preferably 0.1 to 0.6 $g/m^2$, as dry solid matter. When thickness of the back layer is excessively thin, its favorable functions of the back layer can not be exhibited sufficiently. An excessively thicker back layer is unfavorable, because it leads to deterioration in sensitivity during printing.

(Transfer Ink Layer)

The transfer ink layer to be formed on the other face of the substrate film is a layer containing a sublimable dye, i.e., a thermally sublimable dye layer, when it is a sublimable thermal transfer sheet, or alternatively, a heat-fusing ink layer colored, for example, with a pigment, when it is a heat-fusing thermal transfer sheet. Hereinafter, the invention will be described, taking a sublimable thermal transfer sheet as an example, but it should be understood that the present invention is not limited to the sublimable thermal transfer sheet.

The dye used in the sublimable transfer ink layer in the present invention is not particularly limited, if it is a known dye commonly used in thermal transfer sheets. Examples of some of the favorable dyes include red dyes such as MS RED G, Macro Red Violet R, Ceres Red 7B, Samaron Red HBSL, and Resolin Red F3BS; yellow dyes such as Holon Brilliant Yellow 6GL, PTY-52, and Macrolex Yellow 6G; blue dyes such as Kayaset Blue 714, Waxoline Blue AP-FW, Holon Brilliant Blue-S-R, and MS blue 100; and the like.

Favorable examples of the binder resin for supporting such a dye include cellulosic resins such as ethylcellulose, hydroxyethylcellulose, ethylhydroxycellose, hydroxypropylcellulose, methylcellulose, cellulose acetate, and cellulose tributyrate; vinyl resins such as polyvinylalcohol, polyvinyl acetate, polyvinylbutyral, polyvinylacetoacetal, and polyvinylpyrrolidone; acrylic resins such as poly(meth)acrylate and poly(meta)acrylamide; polyurethane resins, polyamide resins, polyester resins, and the like. Among them, cellulosic, vinyl, acrylic, urethane, and polyester resins are preferable from the points of heat resistance and dye-transfer efficiency.

The dye layer can be formed on one face of a substrate film by applying and drying a dispersion containing a dye, a binder, and as needed additives such as releasing agent dissolved or dispersed in a suitable organic solvent such as toluene, methylethylketone, ethanol, isopropyl alcohol, cyclohexanone, or DME or in an aqueous organic solvent, for example, by means of gravure printing, screen printing, or reverse roll coating of using a gravure plate.

The coating amount of the dye layer thus formed is approximately 0.2 to 5.0 $g/m^2$, preferably 0.4 to 2.0 $g/m^2$, as dry solid matter, and the content of the sublimable dye in the dye layer is preferably 5 to 90 percent by mass, more preferably 10 to 70 percent by mass, with respect to the mass of the dye layer. When the desired image is monochromatic, the dye layer formed preferably contains a single dye selected from the dyes above. When the desired image is full-color, for example, the dye layers of yellow, magenta and cyan (additionally black as needed) are formed by selecting yellow, magenta and cyan (additionally black as needed) dyes.

The image-receiving sheet, i.e., an image-receiving medium, for forming an image thereon by using the thermal transfer sheet is not particularly limited, if it has a recording face that receives the dye described above. When it is a non-dye-receiving sheet such as paper, metal, glass, or synthetic resin, a dye-receiving layer is formed at least on one surface thereof. In the case of a heat-fusing transfer sheet, the image-receiving medium is not particularly limited, and any one of common media such as paper and plastic film may be used. The printer used for thermal transfer by using the thermal transfer sheet and the image-receiving layer is not particularly limited, and any one of known thermal transfer printers may be used as it is.

Hereinafter, the present invention will be described with reference to Examples, and the "part" and "%" in Examples means "part by mass" and "percent by mass", unless specified otherwise.

The polyamide-imide resin (HR-15ET, Toyobo Co., Ltd.) used in the following Examples has Tg of 260° C., and the polyamide-imide silicone resin (HR-14ET, Toyobo Co., Ltd.), Tg of 250° C.

EXAMPLE 1

The following materials are dispersed respectively in a mixed solvent of ethanol and toluene at a ratio of 1:1 (mass ratio) to contain a solid content of 10%, and the mixture was stirred and dispersed in a paint shaker for 3 hours, to give a back layer ink. The ink was applied on one face of a polyester film (4.5 μm, Lumirror, manufactured by Toray Industries, Inc.) by using a wire bar coater, to gibe a thickness of 0.5 $g/m^2$ after drying, and dried in an oven at 80° C. for 1 minute. Thus, a back layer was formed.

(Materials for Back Layer)

Polyamide-imide resin (HR-15ET, Toyobo Co., Ltd.) 50 parts

Polyamide-imide silicone resin (HR-14ET, Toyobo Co., Ltd.) 50 parts

Silicone oil (X-22-173DX, Shin-Etsu Chemical Co., Ltd.) 5 parts

Zinc stearyl phosphate (LBT-1830 purified, Sakai Chemical Industry Co., Ltd.) 10 parts Zinc stearate (GF-200, NOF corporation.) 10 parts Polyester resin (Vylon 220, Toyobo Co., Ltd.) 3 parts Inorganic filler (talc, average particle size: 4.2 μm, Mohs' hardness: 3) 10 parts A dye layer was formed as a transfer ink layer on the other face of the substrate film, to give a thermal transfer sheet in Example 1 of the present invention. The dye layer was formed in conditions similar to those for forming the dye layer on the thermal transfer sheet for use in a sublimation printer CP8000 manufactured by Mitsubishi Electric Corporation. The image-receiving sheet (standard type) for sublimation printer CP8000 manufactured by Mitsubishi Electric Corporation was used as an image-receiving layer in the following evaluation.

EXAMPLES 2 TO 9

Thermal transfer sheets were prepared in a manner similar to Example 1, except that the silicone oil (X-22-173DX, Shin-Etsu Chemical Co., Ltd.) used in Example 1 was replaced with the silicone oil shown in the following Table 1.

TABLE 1

| Number | Product name | Manufacturer | Kind (modification type) | Modification position | Viscosity 25° C. $mm^2/s$ | Thermal-head abrasion | Thermal-head staining | Printed-image staining | Printed-image wrinkling |
|---|---|---|---|---|---|---|---|---|---|
| Example 1 | X-22-173DX | Shin-Etsu | Epoxy modified | One terminal | 65 | ○ | ○ | ○ | ○ |
| Example 2 | X-22-163A | Chemical | Epoxy group | Both terminals | 30 | ○ | ○ | ○ | ○ |
| Example 3 | X-22-163B | Co., Ltd. | Epoxy group | Both terminals | 60 | ○ | ○ | ○ | ○ |
| Example 4 | X-22-163C | | Epoxy group | Both terminals | 120 | ○ | ○ | ○ | ○ |
| Example 5 | KF-6003 | | Carbinol modified | Both terminals | 110 | ○ | ○ | ○ | ○ |
| Example 6 | X-22-1821 | | Phenol modified | Both terminals | 100 | ○ | ○ | ○ | ○ |
| Example 7 | X-22-2000 | | Epoxy modified | Side chain | 190 | ○ | ○ | ○ | ○ |
| Example 8 | X-22-174DX | | Methacryl modified | One terminal | 60 | ○ | ○ | ○ | ○ |
| Example 9 | X-22-4952 | | Polyether modified | Both terminals | 90 | ○ | ○ | ○ | ○ |

EXAMPLE 10

A thermal transfer sheet was prepared in a manner similar to Example 1, except that the materials for the back layer on the thermal transfer sheet prepared in Example 1 were replaced with the following compounds.

(Back Layer Materials)

Polyamide-imide resin (HR-15ET, Toyobo Co., Ltd.) 50 parts

Polyamide-imide silicone resin (HR-14ET, Toyobo Co., Ltd.) 50 parts

Silicone oil (KF965-100, Shin-Etsu Chemical Co., Ltd.), 5 parts

Zinc stearyl phosphate (LBT-1830 purified, Sakai Chemical Industry Co., Ltd.) 10 parts Zinc stearate (GF-200, NOF corporation.) 10 parts Polyester resin (Vylon 220, Toyobo Co., Ltd.) 3 parts Inorganic filler (talc, average particle size: 4.2 μm, Mohs' hardness: 3) 10 parts

EXAMPLES 11 TO 15

Thermal transfer sheets were prepared in a manner similar to Example 10, except that the silicone oil (KF965-100, Shin-Etsu Chemical Co., Ltd.) used in Example 10 was replaced with the silicon oil shown in the following Table 2.

EXAMPLE 16

A thermal transfer sheet of Example 16 was prepared in a manner similar to Example 1, except that the materials for the back layer on the thermal transfer sheet prepared in Example 1 were replaced with the following compounds.

(Back Layer Materials)

Polyamide-imide resin (HR-15ET, Toyobo Co., Ltd.) 50 parts

Polyamide-imide silicone resin (HR-14ET, Toyobo Co., Ltd.) 50 parts

Silicone oil (X-22-173DX, Shin-Etsu Chemical Co., Ltd.) 2.5 parts

Silicone oil (KF965-100, Shin-Etsu Chemical Co., Ltd.) 2.5 parts

Zinc stearyl phosphate (LBT-1830 purified, Sakai Chemical Industry Co., Ltd.) 10 parts Zinc stearate (GF-200, NOF corporation.) 10 parts Polyester resin (Vylon 220, Toyobo Co., Ltd.) 3 parts Inorganic filler (talc, average particle size: 4.2 μm, Mohs' hardness: 3) 10 parts

EXAMPLES 17 TO 21

A thermal transfer sheet was prepared in a manner similar to Example 16, except that the silicone oil (X-22-173DX, KF965-100, Shin-Etsu Chemical Co., Ltd.) used in Example 16 was replaced with the silicone oil shown in the following Table 3.

TABLE 2

| Number | Product name | Manufacturer | Kind | Viscosity 25° C. $mm^2/s$ | Thermal-head abrasion | Thermal-head staining | Printed-image staining | Printed-image wrinkling |
|---|---|---|---|---|---|---|---|---|
| Example 10 | KF965-100 | Shin-Etsu Chemical Co., Ltd. | Dimethylsilicone oil | 100 | ○ | ○ | ○ | ○ |
| Example 11 | YF33-100 | GE Toshiba | Dimethylsilicone oil | 100 | ○ | ○ | ○ | ○ |
| Example 12 | YF33-1000 | Silicone Co., Ltd. | | 1000 | ○ | ○ | ○ | ○ |
| Example 13 | KF965-1000 | Shin-Etsu | | 1000 | ○ | ○ | ○ | ○ |
| Example 14 | KF50-100 | Chemical Co., Ltd. | Methylphenylsilicone oil | 100 | ○ | ○ | ○ | ○ |
| Example 15 | KF54 | | | 400 | ○ | ○ | ○ | ○ |

TABLE 3

| Number | Silicone oil Product name | | Thermal-head abrasion | Thermal-head staining | Printed-image staining | Printed-image wrinkling |
|---|---|---|---|---|---|---|
| Example 16 | X-22-173DX | KF965-100 | ○ | ○ | ◎ | ○ |
| Example 17 | X-22-173DX | YF33-100 | ○ | ○ | ◎ | ○ |
| Example 18 | X-22-173DX | KF965-1000 | ○ | ○ | ◎ | ○ |
| Example 19 | X-22-173DX | KF50-100 | ○ | ○ | ◎ | ○ |
| Example 20 | X-22-173DX | KF54 | ○ | ○ | ◎ | ○ |
| Example 21 | KF50-100 | KF54 | ○ | ○ | ◎ | ○ |

EXAMPLE 22

A thermal transfer sheet was prepared in a manner similar to Example 1, except that the materials for the back layer on the thermal transfer sheet prepared in Example 1 were replaced with the following compounds.

(Back Layer Materials)

Polyamide-imide resin (HR-15ET, Toyobo Co., Ltd.) 50 parts

Polyamide-imide silicone resin (HR-14ET, Toyobo Co., Ltd.) 50 parts

Silicone oil (X-22-173DX, Shin-Etsu Chemical Co., Ltd.) 5 parts

Zinc stearyl phosphate (LBT-1830 purified, Sakai Chemical Industry Co., Ltd.) 10 parts Zinc stearate (SZ-PF, Sakai Chemical Industry Co., Ltd.) 10 parts Polyester resin (Vylon 220, Toyobo Co., Ltd.) 3 parts Inorganic filler (talc, average particle size: 4.2 μm, Mohs' hardness: 3) 10 parts

EXAMPLES 23 TO 36

Thermal transfer sheets were prepared in a manner similar to Example 22, except that the silicone oil used in Example 22 (X-22-173DX, Shin-Etsu Chemical Co., Ltd.) was replaced with the silicone oil shown in the following Tables 4 and 5.

TABLE 4

| Number | Product name | Manufacturer | Kind (modification type) | Modification position | Viscosity 25° C. $mm^2/s$ | Thermal-head abrasion | Thermal-head staining | Printed-image staining | Printed-image wrinkling |
|---|---|---|---|---|---|---|---|---|---|
| Example 22 | X-22-173DX | Shin-Etsu | Epoxy modified | One terminal | 65 | ○ | ○ | ○ | ○ |
| Example 23 | X-22-163A | Chemical | Epoxy group | Both terminals | 30 | ○ | ○ | ○ | ○ |
| Example 24 | X-22-163B | Co., Ltd. | Epoxy group | Both terminals | 60 | ○ | ○ | ○ | ○ |
| Example 25 | X-22-163C | | Epoxy group | Both terminals | 120 | ○ | ○ | ○ | ○ |
| Example 26 | KF-6003 | | Carbinol modified | Both terminals | 110 | ○ | ○ | ○ | ○ |
| Example 27 | X-22-1821 | | Phenol modified | Both terminals | 100 | ○ | ○ | ○ | ○ |
| Example 28 | X-22-2000 | | Epoxy modified | Side chain | 190 | ○ | ○ | ○ | ○ |
| Example 29 | X-22-174DX | | Methacryl modified | One terminal | 60 | ○ | ○ | ○ | ○ |
| Example 30 | X-22-4952 | | Polyether modified | Both terminals | 90 | ○ | ○ | ○ | ○ |

TABLE 5

| Number | Product name | Manufacturer | Kind | Viscosity 25° C. $mm^2/s$ | Thermal-head abrasion | Thermal-head staining | Printed-image staining | Printed-image wrinkling |
|---|---|---|---|---|---|---|---|---|
| Example 31 | KF965-100 | Shin-Etsu Chemical Co., Ltd. | Dimethylsilicone oil | 100 | ○ | ○ | ○ | ○ |
| Example 32 | YF33-100 | GE Toshiba | Dimethylsilicone oil | 100 | ○ | ○ | ○ | ○ |
| Example 33 | YF33-1000 | Silicone Co., Ltd. | | 1000 | ○ | ○ | ○ | ○ |
| Example 34 | KF965-1000 | Shin-Etsu Chemical | | 1000 | ○ | ○ | ○ | ○ |
| Example 35 | KF50-100 | Co., Ltd. | Methylphenylsilicone | 100 | ○ | ○ | ○ | ○ |
| Example 36 | KF54 | | oil | 400 | ○ | ○ | ○ | ○ |

EXAMPLE 37

A thermal transfer sheet of Example 37 was prepared in a manner similar to Example 22, except that the materials for the back layer on the thermal transfer sheet prepared in Example 22 were replaced with the following compounds.

(Back Layer Materials)

Polyamide-imide resin (HR-15ET, Toyobo Co., Ltd.) 50 parts
Polyamide-imide silicone resin (HR-14ET, Toyobo Co., Ltd.) 50 parts
Silicone oil (X-22-173DX, Shin-Etsu Chemical Co., Ltd.) 2.5 parts
Silicone oil (KF965-100, Shin-Etsu Chemical Co., Ltd.) 2.5 parts
Zinc stearyl phosphate (LBT-1830 purified, Sakai Chemical Industry Co., Ltd.) 10 parts
Zinc stearate (SZ-PF, Sakai Chemical Industry Co., Ltd.) 10 parts
Polyester resin (Vylon 220, Toyobo Co., Ltd.) 3 parts
Inorganic filler (talc, average particle size: 4.2 μm, Mohs' hardness: 3) 10 parts

EXAMPLES 38 TO 42

Thermal transfer sheets were prepared in a manner similar to Example 37, except that the silicone oils used in Example 37 (X-22-173DX and KF965-100, Shin-Etsu Chemical Co., Ltd.) were replaced with the silicone oil shown in the following Table 6.

TABLE 6

| Number | Silicone oil Product name | | Thermal-head abrasion | Thermal-head staining | Printed-image staining | Printed-image wrinkling |
|---|---|---|---|---|---|---|
| Example 37 | X-22-173DX | KF965-100 | ○ | ○ | ◎ | ○ |
| Example 38 | X-22-173DX | YF33-100 | ○ | ○ | ◎ | ○ |
| Example 39 | X-22-173DX | KF965-1000 | ○ | ○ | ◎ | ○ |
| Example 40 | X-22-173DX | KF50-100 | ○ | ○ | ◎ | ○ |
| Example 41 | X-22-173DX | KF54 | ○ | ○ | ◎ | ○ |
| Example 42 | KF50-100 | KF54 | ○ | ○ | ◎ | ○ |

COMPARATIVE EXAMPLE 1

A thermal transfer sheet of Comparative Example 1 was prepared in a manner similar to Example 1, except that the silicone oil in the materials for the back layer on the thermal transfer sheet prepared in Example 1 was eliminated.

(Back Layer Materials)

Polyamide-imide resin (HR-15ET, Toyobo Co., Ltd.) 50 parts
Polyamide-imide silicone resin (HR-14ET, Toyobo Co., Ltd.) 50 parts
Zinc stearyl phosphate (LBT-1830 purified, Sakai Chemical Industry Co., Ltd.) 10 parts
Zinc stearate (GF-200, NOF corporation.) 10 parts
Polyester resin (Vylon 220, Toyobo Co., Ltd.) 3 parts
Inorganic filler (talc, average particle size: 4.2 μm, Mohs' hardness: 3) 10 parts

COMPARATIVE EXAMPLE 2

A thermal transfer sheet of Comparative Example 2 was prepared in a manner similar to Example 1, except that the amount of the silicone oil in the materials for the back layer on the thermal transfer sheet prepared in Example 1 was altered.

(Back Layer Materials)

Polyamide-imide resin (HR-15ET, Toyobo Co., Ltd.) 50 parts
Polyamide-imide silicone resin (HR-14ET, Toyobo Co., Ltd.) 50 parts
Silicone oil (X-22-173DX, Shin-Etsu Chemical Co., Ltd.) 50 parts
Zinc stearyl phosphate (LBT-1830 purified, Sakai Chemical Industry Co., Ltd.) 10 parts
Zinc stearate (GF-200, NOF corporation.) 10 parts
Polyester resin (Vylon 220, Toyobo Co., Ltd.) 3 parts
Inorganic filler (talc, average particle size: 4.2 μm, Mohs' hardness: 3) 10 parts

COMPARATIVE EXAMPLE 3

A thermal transfer sheet of Comparative Example 3 was prepared in a manner similar to Example 1, except that the hardness of the inorganic filler in the materials for the back layer on the thermal transfer sheet prepared in Example 1 was changed to 7.

(Back Layer Materials)

Polyamide-imide resin (HR-15ET, Toyobo Co., Ltd.) 50 parts
Polyamide-imide silicone resin (HR-14ET, Toyobo Co., Ltd.) 50 parts
Silicone oil (X-22-173DX, Shin-Etsu Chemical Co., Ltd.) 5 parts
Zinc stearyl phosphate (LBT-1830 purified, Sakai Chemical Industry Co., Ltd.) 10 parts
Zinc stearate (GF-200, NOF corporation.) 10 parts
Polyester resin (Vylon 220, Toyobo Co., Ltd.) 3 parts
Inorganic filler (talc, average particle size: 4.9 μm, Mohs'hardness: 7) 10 parts

COMPARATIVE EXAMPLE 4

A thermal transfer sheet of Comparative Example 4 was prepared in a manner similar to Example 1, except that the particle size of the inorganic filler in the materials for the back layer on the thermal transfer sheet prepared in Example 1 was changed to 7.4 μm.

(Back Layer Materials)

Polyamide-imide resin (HR-15ET, Toyobo Co., Ltd.) 50 parts
Polyamide-imide silicone resin (HR-14ET, Toyobo Co., Ltd.) 50 parts
Silicone oil (X-22-173DX, Shin-Etsu Chemical Co., Ltd.) 5 parts
Zinc stearyl phosphate (LBT-1830 purified, Sakai Chemical Industry Co., Ltd.) 10 parts
Zinc stearate (GF-200, NOF corporation.) 10 parts
Polyester resin (Vylon 220, Toyobo Co., Ltd.) 3 parts
Inorganic filler (talc, average particle size: 7.4 μm, Mohs' hardness: 3) 10 parts (Evaluation)

Characteristics such as thermal-head abrasion, thermal-head staining, printed-image staining, and printed-image wrinkling were evaluated by using the thermal transfer sheets obtained in Examples and Comparative Examples. Results with the thermal transfer sheets obtained in Examples 1 to 42 are summarized in Tables 1 to 6 and those with the thermal transfer sheets obtained in Comparative Examples 1 to 4 in the following Table 7.

TABLE 7

| | Thermal-head abrasion | Thermal-head staining | Printed-image staining | Printed-image wrinkling |
|---|---|---|---|---|
| Comparative example 1 | ○ | ○ | X | ○ |
| Comparative example 2 | ○ | Δ | ◎ | X |
| Comparative example 3 | X | ○ | X | Δ |
| Comparative example 4 | Δ | ○ | ○ | ○ |

(Thermal-head Abrasion)

A solid image was printed continuously over a length of 10 km by a sublimation printer (trade name: CP8000, manufactured by Mitsubishi Electric Corporation), and abrasion of the protective film on the thermal head was examined.

(Evaluation Criteria)

○: Less than 1 μm

Δ: 1 to 3 μm

X: More than 3 μm (Thermal-head Staining)

The amount of stains on a thermal-head heater unit after a 50 area % hatched pattern was printed over a length of 100 m while a load of 4 kgf and a printing energy of 0.44 mJ/dot were applied to the thermal head (KST-105-13FAN21-MB (manufactured by Kyocera corporation)) was examined under a microscope.

(Evaluation Criteria)

○: Less than 3,000 Å

Δ: 3,000 to 5,000 Å

X: More than 5,000 Å

(Printed-image Staining)

A solid image pattern and a half-tone image pattern were printed by a sublimation printer (trade name: CP8000, manufactured by Mitsubishi Electric Corporation), and presence of stains on the printed image by tailing was examined.

(Evaluation Criteria)

◎: No printed-image staining by tailing

○: Slight printed-image staining by tailing observed, but no practical problem

X: Defective printed image with significant printed-image staining by tailing.

(Printed-image Wrinkling)

A solid image was printed by a sublimation printer (trade name: CP8000, manufactured by Mitsubishi Electric Corporation.), and the number of cockles (wrinkling) generated on the printed image was examined by visual observation.

(Evaluation Criteria)

○: None

Δ: 1 to 3

X: More than 3

The invention claimed is:

1. A thermal transfer sheet, comprising a substrate film, a transfer ink layer formed on one face thereof, and a back layer formed on the other face thereof, wherein the back layer comprises:

a mixed binder containing a polyamide-imide resin (A) having a Tg of 200° C. or higher as determined by differential thermal analysis and a polyamide-imide silicone resin (B) having a Tg of 200° C. or higher;

a mixture of a polyvalent metal salt of alkylphosphoric ester (C) and a metal salt of alkylcarboxylic acid (D), a silicone oil (E); having viscosity of 10 to 1,100 $mm^2$/sec comprising a combination of a modified silicone oil selected from epoxy-, carbinol-, phenol-, methacrylic- or polyether-modified silicone oils, with an unmodified silicone oil selected from dimethylsilicone oil, methylphenylsilicone oil, or mixture thereof; and an inorganic filler (F).

2. The thermal transfer sheet according to claim 1, wherein the blending ratio of the mixture of a polyamide-imide resin (A) and a polyamide-imide silicone resin (B) is A:B=1:5 to 5:1 by mass.

3. The thermal transfer sheet according to claim 2, wherein the blending ratio of the mixture of a polyvalent metal salt of alkylphosphoric ester (C) and a metal salt of alkylcarboxylic acid is C:D=1:9 to 9:1 by mass.

4. The thermal transfer sheet according to any one of claims 1 to 3, wherein the content of the silicone oil is 1 to 30 parts by mass with respect to 100 parts by mass of the binder.

5. The thermal transfer sheet according to claim 1, wherein the average particle size of the inorganic filler is 0.05 to 5 μm and the Mohs' hardness thereof is 3 or less.

6. The thermal transfer sheet according to claim 1, wherein the inorganic filler is talc, mica, calcium carbonate or the mixture thereof.

7. The thermal transfer sheet according to claim 1, wherein the content of the inorganic filler is 2 to 20 parts by mass with respect to 100 parts by mass of the binder.

* * * * *